US005659144A

United States Patent [19]

Shigenaga

[11] Patent Number: 5,659,144

[45] Date of Patent: Aug. 19, 1997

[54] FOOT PEDAL FOR A DRUM

[75] Inventor: Fumihiro Shigenaga, Hamamatsu, Japan

[73] Assignee: Yamaha Corporation, Shizuoka, Japan

[21] Appl. No.: 461,640

[22] Filed: Jun. 5, 1995

[30] Foreign Application Priority Data

Nov. 15, 1994 [JP] Japan ..... 6-280373

[51] Int. Cl.[6] ..... G10D 13/02

[52] U.S. Cl. ..... 84/422.1

[58] Field of Search ..... 84/422.1, 422.2

[56] References Cited

U.S. PATENT DOCUMENTS

| | | | |
|---|---|---|---|
| 4,538,499 | 9/1985 | Livingston | 84/422.1 |
| 4,644,842 | 2/1987 | Aluisi | 84/422.1 |
| 5,297,467 | 3/1994 | Hoshino | 84/422.1 |

FOREIGN PATENT DOCUMENTS

| | | |
|---|---|---|
| 55-45433 | 10/1980 | Japan . |
| 58-43031 | 9/1983 | Japan . |
| 58-43035 | 9/1993 | Japan . |

*Primary Examiner*—Cassandra C. Spyrou
*Attorney, Agent, or Firm*—Koda and Androlia

[57] ABSTRACT

In a foot pedal for a drum, the beater which pivots to strike the drum head when a pedal board is depressed by the player can be moved and adjusted in the forward-backward and left-right directions relative to the drum head via a simple structure which includes a beater holding mechanism. The beater holding mechanism is provided on a rotatable shaft linked to the pedal board and includes a holder and a movable member which is rotatably installed in a hole formed in the holder so that the movable member is rotated and also moved in the axial direction of the rotatable shaft which is installed horizontally. A beater rod which has the beater at the end is attached to the movable member. Thus, when the movable member is rotated in the hole of the holder, the distance between the beater and the drum head surface is changed; and when the movable member is moved horizontally in the hole of the holder, the beater is moved closer to and away from the center of the drum head.

1 Claim, 5 Drawing Sheets

FOOT PEDAL FOR A DRUM

BACKGROUND OF THE INVENTION

1. Field of the Invention

The present invention relates to a foot pedal for a drum in which the drum head of a bass drum is struck when the foot pedal is depressed with the foot and more particularly to a drum foot pedal which is designed so that the position of the beater of the foot pedal can be freely changed to suit the player.

2. Prior Art

Various drum foot pedals of this type, in which a beater is caused to pivot by the depression of a foot board so that the beater strikes the drum head of a bass drum, have been proposed in the past (examples: Japanese Utility Model Application Publication No. 55-45433, Japanese Utility Model Application Publication No. 58-43035, etc.)

FIG. 6 is a perspective view which shows a conventional example of such a foot pedal for a drum. This conventional foot pedal may be described briefly as follows: the drum foot pedal 1 is equipped with a pedal frame 2 which is to be placed on the floor surface. This pedal frame 2 is made up of a frame main body 2A, a pair of left and right supporting columns 2B which are installed in upright positions on the upper surface of the frame main body 2A, and a heel 2C which is connected to the frame main body 2A via a connecting member 3, etc. A clamping member 6 which holds the tightening frame (or hoop) 5 of a bass drum 4 is attached to the frame main body 2A. A rotatable shaft 7 is provided between the upper ends of the pair of supporting columns 2B, 2B via bearings so that the rotatable shaft 7 is free to rotate, and a rocker 8 is attached to the center of the rotatable shaft 7. Furthermore, a beater 10 which strikes the drum head 9 of the bass drum 4 is provided on the rocker 8 via a beater rod 11, and one end of a pedal depressing force transmission member 13 which transmits the depressing force of a foot board 12 to the beater 10 is connected to the rocker 8. A timing belt, a flexible leather or plastic band or a chain, etc. may be used as the pedal depressing force transmission member 13. The foot board 12 is formed as a flat plate of sufficient size to accommodate the foot. The front end **12*a* of the foot board 12 is connected to the other end of the pedal depressing force transmission member 13, and the rear end 12*b* of the foot board 12 is connected to the heel 2C via a shaft 14 so that the foot board 12 can pivot upward and downward. Furthermore, the upper end of a return spring 15 which imparts a pivoting habit to the foot board 12 in the return direction is connected to one end of the rotatable shaft 7 via a cam plate 16, and the lower end of this return spring 15 is connected to a spring receiving member 17 which is provided at the lower end of one of the supporting columns 2B**.

Furthermore, 18 indicates a hoop fastening screw which presses the clamping part 6 against the hoop 5.

In the drum foot pedal 1 constructed as described above, the foot board 12 is ordinarily maintained at a prescribed inclination with the front end lifted as shown in the Figure by the spring force of the return spring 15. When a depressing force is applied to the foot board 12 in this state, the pedal depressing force transmission member 13 is pulled downward, and the beater 10 pivots along with the rotatable shaft 7 and strikes the drum head 9 of the bass drum 4. The maximum angle of depression of the foot board 12 in this case is approximately 15°. When the depressing force is removed from the foot board 12 after the beater 10 has struck the drum head 9, the foot board 12 is caused to pivot upward by the spring force of the return spring 15, so that the foot board 12 returns to its initial position.

However, in the convention drum foot pedal 1 as described above, the beater rod 11 is merely fastened to the rocker 8 which in turn is fastened to the rotatable shaft 7 in such a manner that the length of the beater rod 11 can be adjusted. Accordingly, the pivoting angle of the beater 10 and the striking position of the beater 10 on the drum head surface is not adjusted freely. In this case, it is possible to attach the rocker 8 to the rotatable shaft 7 so that the rocker 8 can pivot relative to the rotatable shaft 7 so that the pivoting angle of the beater 10 can be changed. However, since the pedal depressing force transmission member 13 is connected thereto, moving adjustment in the left-right direction is impossible. In other words, adjustment is possible only in one direction.

A twin foot pedal for a drum as disclosed in, for example, Japanese Utility Model Application Publication No. 58-43031 is known as one method for solving the problem. In this twin foot pedal for a drum, two sets of foot pedals, rotatable shafts and beaters are employed, and the two supporting columns which support each rotatable shaft are constructed so that the height of the supporting columns is adjusted. Furthermore, rockers are provided on the respective rotatable shafts so as to be movable in the axial direction. In this construction, the player can freely move the respective beaters in two directions, upward/downward and left/right, as desired and can thus perform drumming which is richer in variations. Furthermore, such a device can be commonly used with various bass drums of different sizes.

However, in such a twin foot pedal for drums, the structure of the foot pedal is complicated, and the number of parts required is large. As a result, manufacture and assembly are difficult, and the resulting device is not only expensive, but also has an increased size and weight.

SUMMARY OF THE INVENTION

Accordingly, the present invention is devised in light of the conventional problems. The object of the present invention is to provide a foot pedal for a drum which is designed so that the beater can be freely moved and adjusted in two directions, forward-backward and left-right, by means of a relatively simple structure.

In order to accomplish the object, the invention is characterized in that in a foot pedal for a drum in which a beater is caused to pivot and strike the drum head by the depression of a foot board installed in a pedal frame, a beater holding mechanism which holds the beater rod for the beater is provided on a rotatable shaft which is rotatably supported on the pedal frame so that the beater rod can be moved in the left-right direction and forward-backward direction.

The invention is characterized in that in the foot pedal as described above, the beater holding mechanism comprises a holder, which is fastened to the rotatable shaft, and a movable member, which is held by the holder so that the movable member can rotate in the direction which causes the beater to come close to and away from the drum head and so that the movable member can move in the left-right direction, and the beater rod is attached to this movable member.

The invention is characterized in that in the foot pedal as described above, the movable member is formed in the shape of a cylinder.

The invention is characterized in that in the foot pedal as described above, the beater holding mechanism is comprised of a holder, which is fastened to the rotatable shaft, and a movable member, which is held by the holder so that the movable member can rotate in at least the forward-backward direction and left-right direction, and the beater rod is attached to this movable member.

The invention is characterized in that in the foot pedal as described above, the movable member is a spherical body.

In the invention described above, the movable member of the beater holding mechanism is provided so that the movable member can be moved in the forward-backward direction and in the left-right direction with respect to the holder. Accordingly, the beater can be moved and adjusted in two directions, i.e., the forward-backward direction and the left-right direction.

In the invention described above, the movable member of the beater holding mechanism is provided on the holder so that the movable member can rotate in at least the forward-backward and left-right directions. Accordingly, the beater can be moved and adjusted in two directions, i.e., the forward-backward direction and the left-right direction.

DETAILED DESCRIPTION OF THE INVENTION

Below, the present invention will be described in detail based upon the embodiments which are illustrated in the accompanying drawings.

Figure 1:
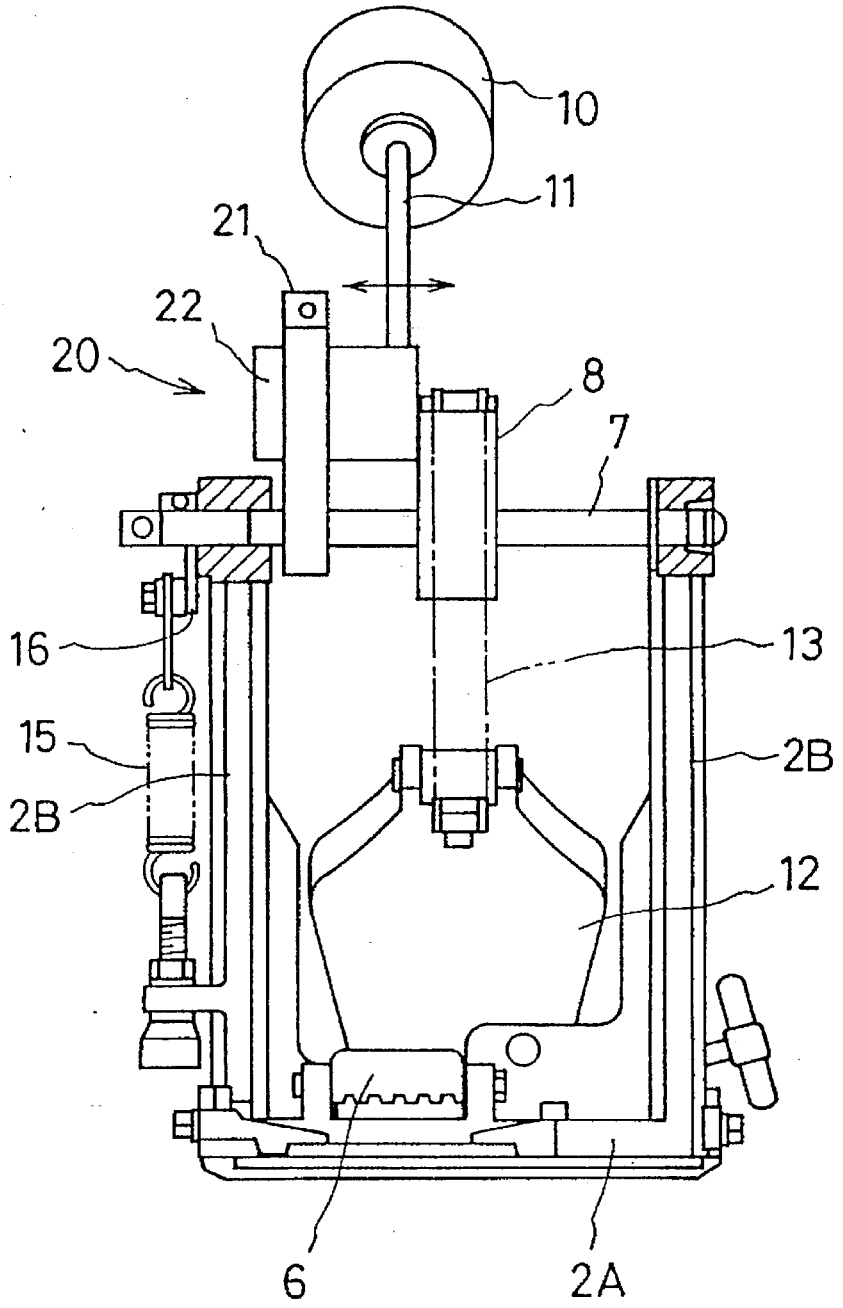
FIG. 1 is a front view of one embodiment of the drum foot pedal of the present invention.
Figure 2:
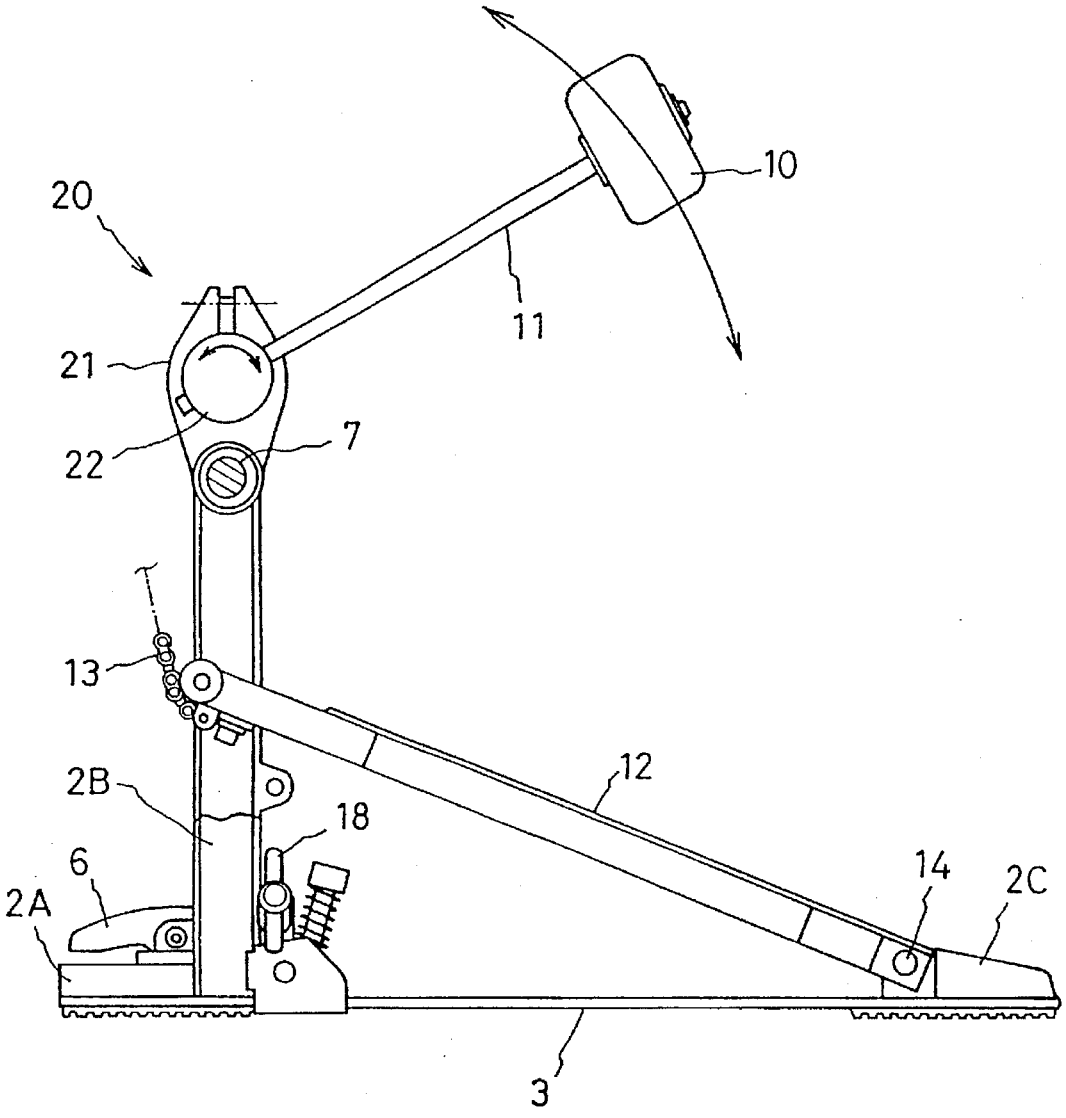
FIG. 2 is a sectional side view of the same pedal.
Figure 3:
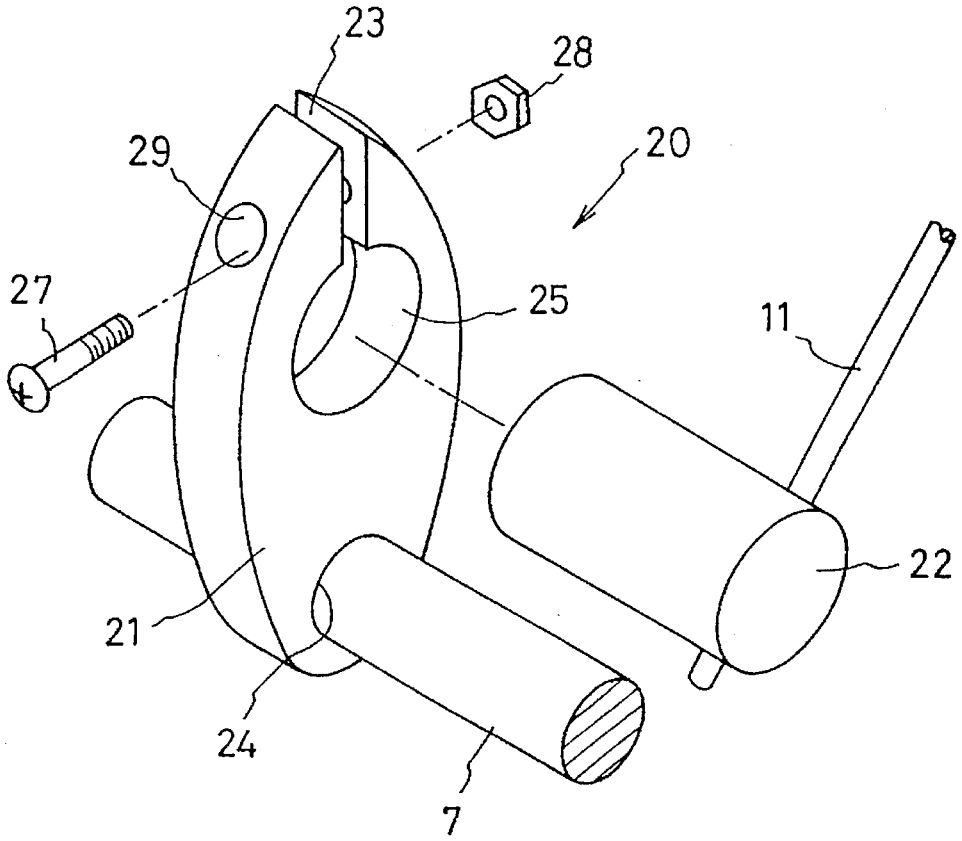
FIG. 3 is an exploded perspective view of the beater holding mechanism.
Figure 6:
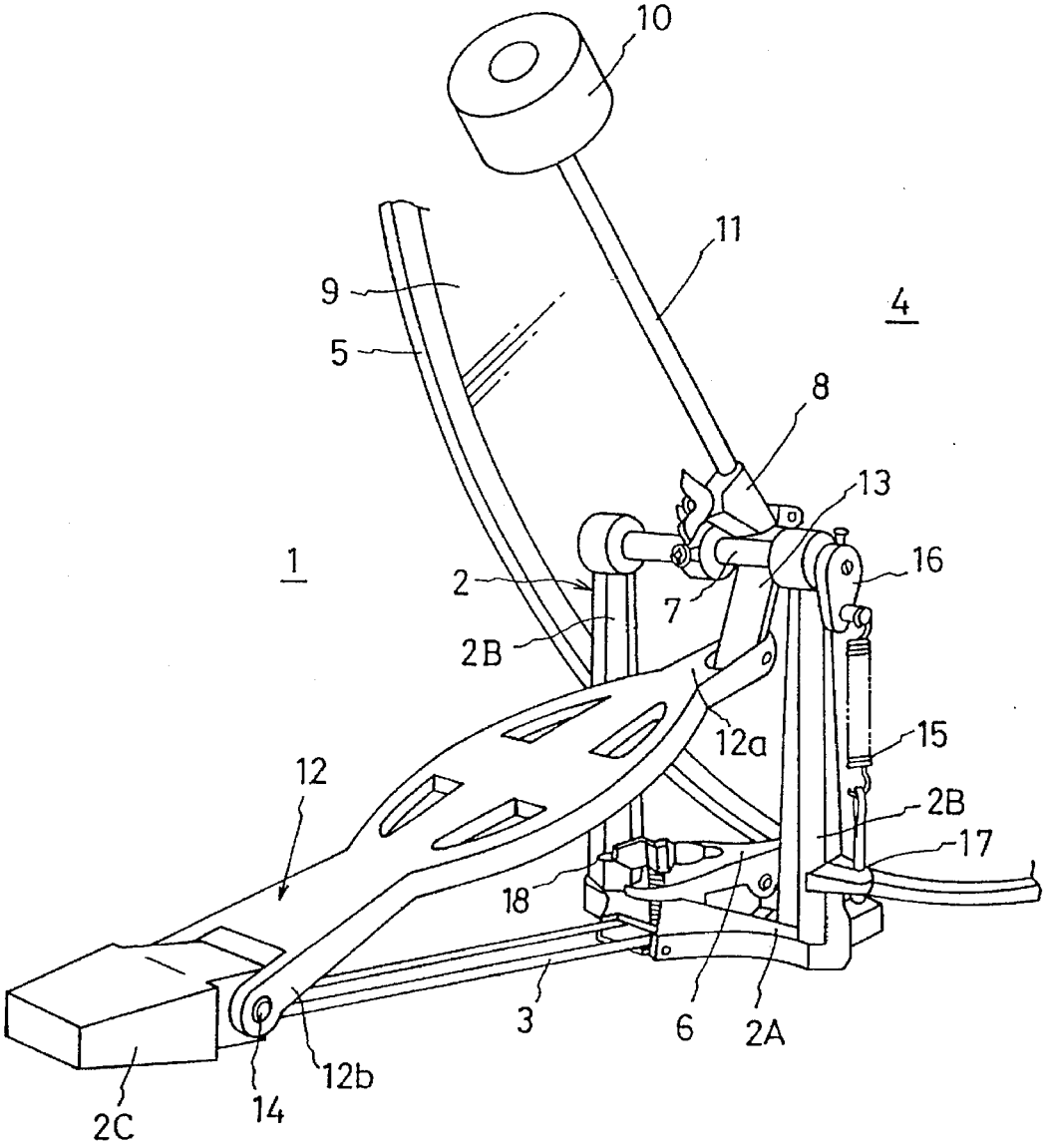
FIG. 6 is a perspective view of a conventional example of a drum foot pedal.

FIG. 1 is a front view showing one embodiment of the foot pedal for a drum provided by the present invention. FIG. 2 is a sectional side view of the same pedal. FIG. 3 is an exploded perspective view of the beater holding mechanism. In these Figures, constituent components which are the same as in FIG. 6 are indicated by the same symbols, and a description of these components is omitted. In the embodiment illustrated in these Figures, the rocker 8 and a beater holding mechanism 20 are provided on the rotatable shaft 7 which is rotatably provided via bearings so as to be located between the upper ends of a pair of left and right supporting columns 2B which are installed uprightly on the frame main body 2A. The rocker 8 and the foot board 12 are connected to each other by the pedal depressing force transmission member 13, and the beater 10 is provided on the beater holding mechanism 20 via the beater rod 11 so that the beater 10 can be moved and adjusted in the forward-backward and left-right directions. All other structures are roughly the same as in the conventional structure illustrated in FIG. 6.

In the case of this embodiment, a chain is used as the pedal depressing force transmission member 13. However, the present invention is not limited to the chain, and it goes without saying that a leather or plastic belt or a timing belt, etc. can be used instead.

As shown in FIG. 3, the beater holding mechanism 20 is composed of a holder 21 which is attached to the rotatable shaft 7 and a movable member 22 which is provided in the holder 21 so that the movable member 22 can rotate and can move in the axial direction. The base end portion of the beater rod 11 is attached to this movable member 22. The holder 21 has an elliptical shape. A cut-out groove 23 is formed at one end of the holder 21 in the direction of the major axis, and two through-holes 24 and 25 are respectively formed in both end portions of the holder 21. The rotatable shaft 7 is inserted and fastened in place in the through-holes 24. The other through-hole 25 is formed so as to communicate with the cut-out groove 23, and one end of the movable member 22 is rotatably engaged with this through-hole 25. The movable member 22 is fastened in place in this through-hole 25 by a setscrew 27 and nut 28. For this purpose, a screw attachment hole 29 which communicates with the cut-out groove 23 is formed through the side surfaces of the holder 21 at the end of the holder 21 where the through-hole 25 is provided. When the setscrew 27 is passed through this screw attachment hole 29 and the nut 28 is tightened on the setscrew 27, the width of the cut-out groove 23 is reduced and the diameter of the through-hole 25 is decreased. As a result, the movable member 22 is clamped in place. The movable member 22 is formed in a cylindrical shape which is capable of engaging with the through-hole 25. A rod attachment hole (not shown in the Figures) through which the base end portion of the beater rod 11 is passed so that the length of the beater rod 11 is adjusted is formed in the movable member 22 so as to extend from one circumferential surface to the other circumferential surface of the movable member 22.

When the setscrew 27 is loosened in the drum foot pedal 1 constructed as described above, the movable member 22 becomes free to rotate and free to move with respect to the holder 21. Accordingly, the beater 10 can be moved in the forward-backward direction, i.e., in the direction which causes the beater 10 to come close to and away from the drum head of the bass drum, and can also be moved and adjusted in the left-right direction, as desired by the player. In other words, the maximum pivoting angle of the beater 10 and the position at which the beater 10 strikes the surface of the drum head can be freely adjusted. Accordingly, by shifting the beater 10 to the left or right from the center of the drum head surface so that the beater 10 strikes the drum head in an area located near the edge of the drum head, the player can perform drumming which is rich in variations.

Furthermore, since the beater holding mechanism 20 is constructed from the holder 21 and movable member 22, the structure is simple and the number of parts required is small. Accordingly, assembly is easy. Furthermore, since the positional adjustment of the beater 10 in two directions, forward-backward and left-right, can be accomplished via a single setscrew 27, adjustment is also simple and easy.

Figure 4:
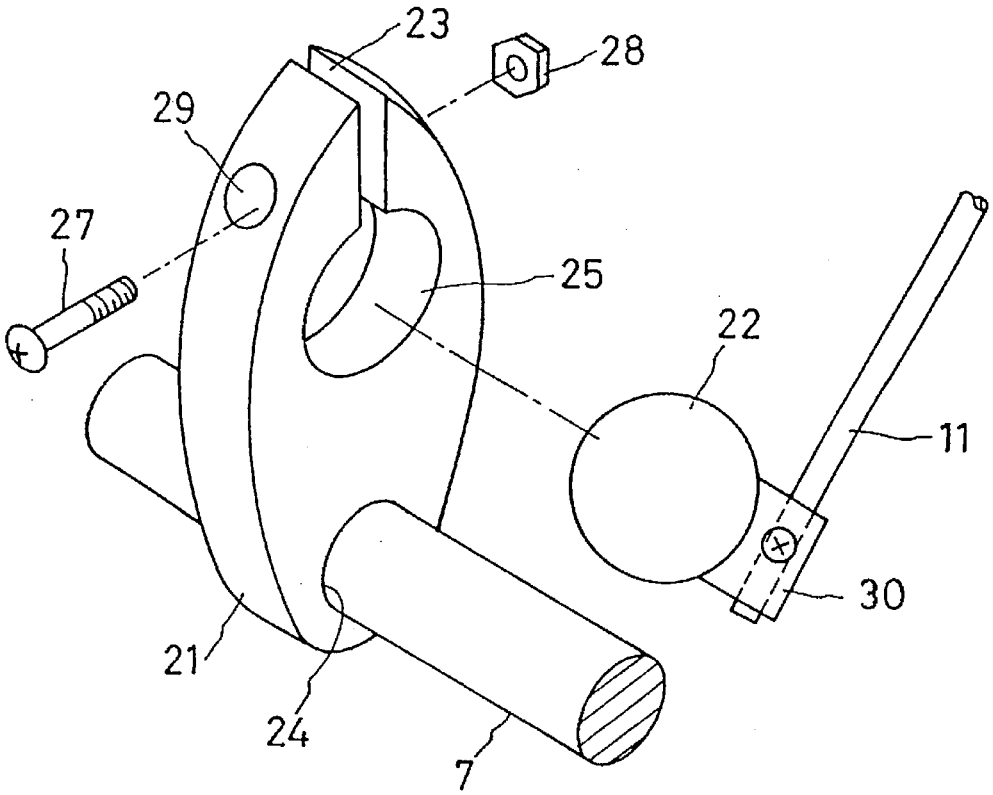
FIG. 4 is an exploded perspective view of another embodiment of the beater holding mechanism.
Figure 5:
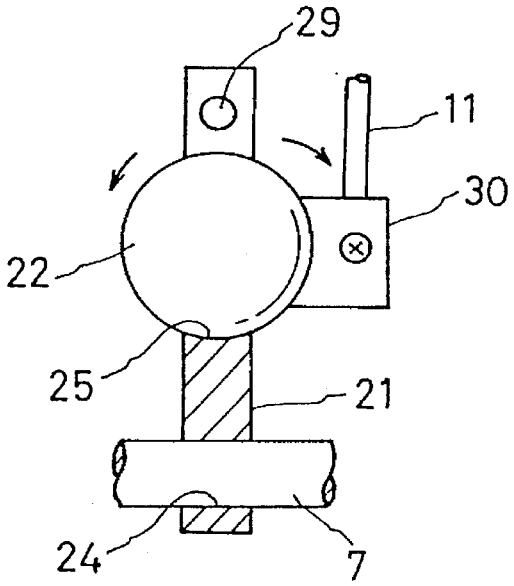
FIG. 5 is a sectional view of the mechanism shown in FIG. 4.

FIGS. 4 and 5 are an exploded perspective view and a sectional view which illustrate another embodiment of the beater holding mechanism.

In this embodiment, the movable member 22 is formed as a spherical body, and a block 30 which holds the base end portion of the beater rod 11 in place in such a manner that the length of the beater rod 11 is adjusted is attached to one portion of the spherical surface of the movable member 22. The through-hole 25 of the holder 21 is formed as a spherical hole so that the movable member 22 can engage with the through-hole 25; as a result, the movable member 22 is prevented from slipping out. The movable member 22 can be inserted into the through-hole 25 by pressing the movable member 22. The other structure is the same as in the embodiment described above.

In this construction as well, the beater 10 can be moved and adjusted in the forward-backward and left-right directions by loosening the setscrew 27 and causing the movable member 22 to rotate in the forward-backward and left-right directions. In this case, since the movement in the left-right direction is accomplished by the rotating movement of the movable member 22 in the direction indicated by arrows in FIG. 5, the beater rod 11 and beater 10 are inclined in the left-fight direction. However, as long as this movement is not accompanied by any rotation in the forward-backward direction, the drum head can be struck in the same manner as in ordinary playing.

However, since the movable member 22 can be caused to move in all directions in this embodiment, the beater 10 can be moved and adjusted three-dimensionally. In this case, drum playing which is different from ordinary playing is possible.

Furthermore, in the embodiments described above, the present invention is applied to a drum foot pedal with a single foot board 12. However, the invention is not limited to such an application. It goes without saying that it is also possible to apply the invention to a twin type drum foot pedal similar to that described in the Japanese Utility Model Application Publication No. 58-43031.

As described above, in the drum foot pedals of the invention, the movable member of the beater holding mechanism is a cylindrical body, and this movable member is provided so as to rotate in the forward-backward direction with respect to the holder and to move in the left-right direction with respect to the holder. Accordingly, the beater can be freely moved and adjusted in two directions, i.e., the forward-backward direction and the left-right direction. Thus, the striking force of the beater against the drum head and the striking position of the beater can be freely changed as desired by the player and in accordance with drums of different sizes.

Furthermore, in the drum foot pedals of the invention, the movable member of the beater holding mechanism is a spherical body, and this movable member is provided in the holder so that it can rotate in at least the forward-backward and left-right directions. Accordingly, the beater can be freely moved and adjusted in two directions, i.e., the forward-backward direction and the left-fight direction. Thus, the striking force of the beater against the drum head and the striking position of the beater can be freely changed as desired by the player and in accordance with drums of different sizes.

Furthermore, such a movable member of the spherical body can be held so as to rotate in all directions. In this case, the beater can be moved and adjusted in three dimensions, and drumming which differs from ordinary playing is possible.

I claim:

1. A foot pedal for a drum in which a beater is caused to pivot and strike a drum head by a depression of a foot board installed in a pedal frame, wherein a beater holding mechanism which holds a beater rod for the beater is provided on a rotatable cylindrical shaft which is rotatably supported on the pedal frame such that the beater rod is movable and fixable in a longitudinal direction of the rotatable cylindrical shaft and rotatable and fixable relative to the rotatable cylindrical shaft in a direction toward or away from said drum head, the beater holding mechanism comprises a holder, which is fastened to the rotatable shaft, and a moveable member, which is held by the holder so that the movable member is rotatable in at least the direction toward and away from said drum head, and in said longitudinal direction, the beater rod being attached to the movable member and the movable member is a spherical body.

* * * * *